US008821075B2

(12) United States Patent
McCartney et al.

(10) Patent No.: US 8,821,075 B2
(45) Date of Patent: Sep. 2, 2014

(54) YIELDABLE SUPPORT PROP AND METHOD

(75) Inventors: Clifford A. McCartney, Eighty Four, PA (US); Thomas P. O'Donnell, Venetia, PA (US)

(73) Assignee: Strata Products Worldwide LLC, Sandy Springs, GA (US)

( * ) Notice: Subject to any disclaimer, the term of this patent is extended or adjusted under 35 U.S.C. 154(b) by 0 days.

(21) Appl. No.: 13/317,720

(22) Filed: Oct. 26, 2011

(65) Prior Publication Data

US 2013/0108376 A1 May 2, 2013

(51) Int. Cl.
*E21D 15/28* (2006.01)

(52) U.S. Cl.
CPC ..... *E21D 15/285* (2013.01); *E21D 15/28* (2013.01)
USPC ..... 405/294; 405/288; 405/290

(58) Field of Classification Search
CPC ..... E21D 15/00; E21D 15/14; E21D 15/22; E21D 15/28
USPC ..... 248/200.1, 644, 351, 354.1, 354.2; 405/288, 290, 294, 271, 272, 293, 298
See application file for complete search history.

(56) References Cited

U.S. PATENT DOCUMENTS 3,538,785 A * 11/1970 Grancon ..... 74/492
4,028,796 A * 6/1977 Bergstrom ..... 29/416
4,313,695 A * 2/1982 McCartney ..... 405/259.1
5,174,421 A * 12/1992 Rink et al. ..... 188/374
5,314,161 A * 5/1994 Domanski et al. ..... 248/548
5,564,867 A * 10/1996 Domanski et al. ..... 405/290
5,921,718 A 7/1999 Kolk
2007/0267559 A1* 11/2007 Spearing et al. ..... 248/354.1
2008/0240868 A1* 10/2008 Bolton et al. ..... 405/288

FOREIGN PATENT DOCUMENTS

RU 2155266 C2 8/2000

OTHER PUBLICATIONS

Barczak, T.M. and Tadolini, S.C., Standing Support Alternatives in Western Longwalls, Feb. 2005, SME Annual Meeting, Salt Lake City, Utah, preprint May 1978. Littleton, CO, Society for Mining, Metallurgy, and Exploration, Inc., p. 9.*

* cited by examiner

*Primary Examiner* — John Kreck
*Assistant Examiner* — Jessica H Lutz
(74) *Attorney, Agent, or Firm* — Ansel M. Schwartz

(57) ABSTRACT

A yield support prop for a mine includes a first metal tube extending from the mine floor having a first portion having a first outside diameter and a second portion having a second outside diameter. The prop includes a second metal tube that is disposed about the first portion and extends toward the mine roof, when the second tube receives a load from the mine roof, the second portion deforms the second tube and expands the second tube creating resistance against the load from the mine roof. A method for supporting a mine roof. A method for building a yieldable mine prop.

18 Claims, 11 Drawing Sheets

YIELDABLE SUPPORT PROP AND METHOD

FIELD OF THE INVENTION

The present invention is related to a yieldable mine support prop having a first portion having a first outside diameter and a second portion having a second outside diameter which creates resistance to a second tube of the prop as the second tube receives load from the mine roof. (As used herein, references to the "present invention" or "invention" relate to exemplary embodiments and not necessarily to every embodiment encompassed by the appended claims.) More specifically, the present invention is related to a yieldable mine support prop having a first portion having a first outside diameter and a second portion having a second outside diameter which creates resistance to a second tube of the prop as the second tube receives load from the mine roof where the second portion is a welded bead or ring.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

It has been long recognized in the mining industry that the ability of a support to be able to accept ground movement and still maintain the integrity of the support is a very useful feature particularly in the situations found in coal and metal mining where the mined material extraction method results in high vertical and horizontal stress environments and the tendency for closure of the mined openings and access ways. In the past, various timber, steel and cement based structures have been utilized to provide support in these environments. The technology disclosed addresses some of the short comings of current steel elongate support technologies.

BRIEF SUMMARY OF THE INVENTION

The present invention pertains to a yield support prop for a mine. The prop comprises a first metal tube extending from the mine floor having a first portion having a first outside diameter and a second portion having a second outside diameter. The prop comprises a second metal tube that is disposed about the first portion and extends toward the mine roof, when the second tube receives a load from the mine roof, the second portion deforms the second tube and expands the second tube creating resistance against the load from the mine roof.

The present invention pertains to a method for supporting a mine roof. The method comprises the steps of placing a yieldable mine prop in the mine so a first metal tube of the prop extends from the mine floor and a second metal tube of the prop extends from the first tube toward the mine roof. There is the step of receiving a load from the mine roof by the second tube. There is the step of moving the second tube under the load against resistance from a second portion of the first tube that extends from a first portion of the first tube that deforms the second tube.

The present invention pertains to a method for building a yieldable mine prop. The method comprises the steps of fitting a bottom end of a second metal tube over a top end of a first metal tube. There is the step of moving the bottom end of the second tube against a second portion of the first tube which extends from a first portion of the first tube.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 6:
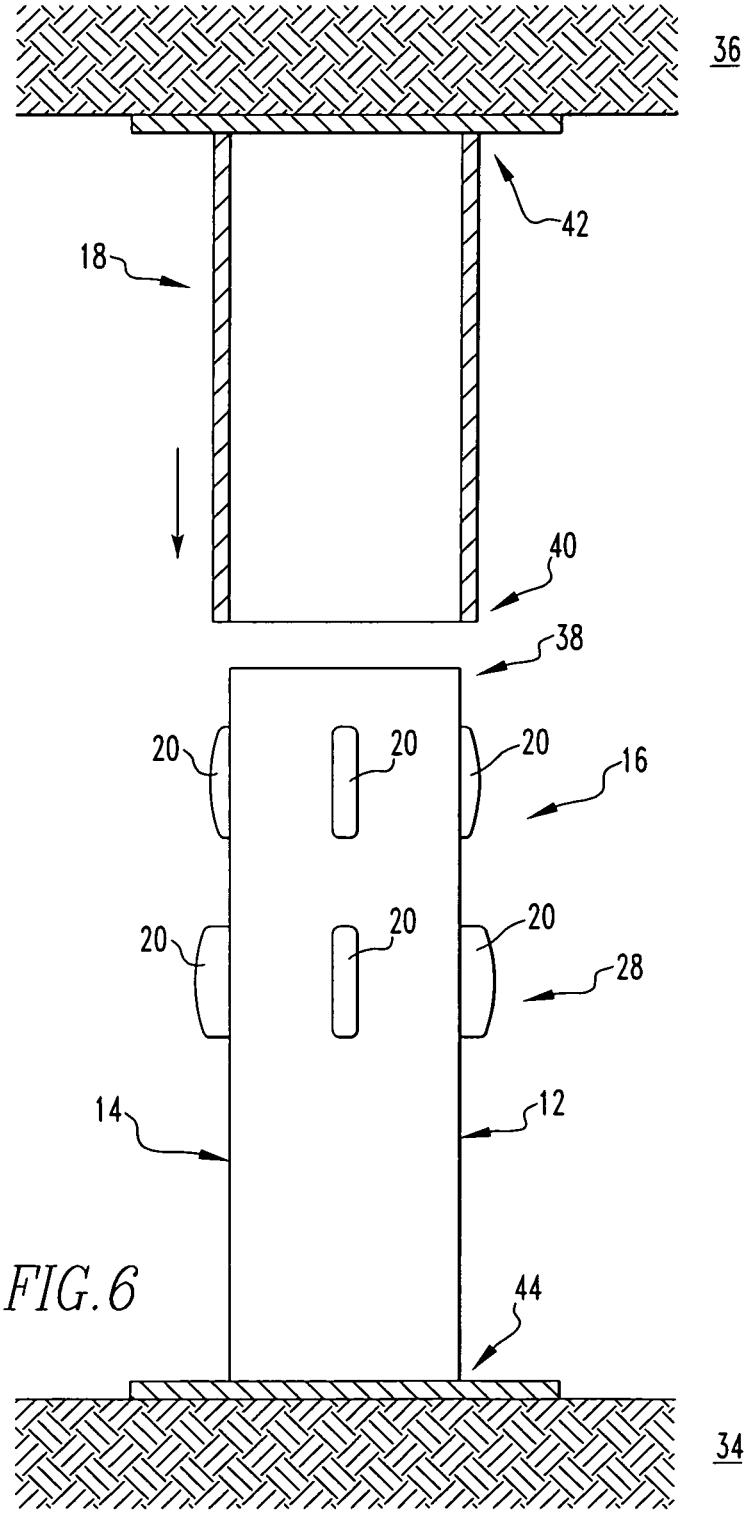
FIG. 6 shows a yieldable mine prop with weld beads.
Figure 7:
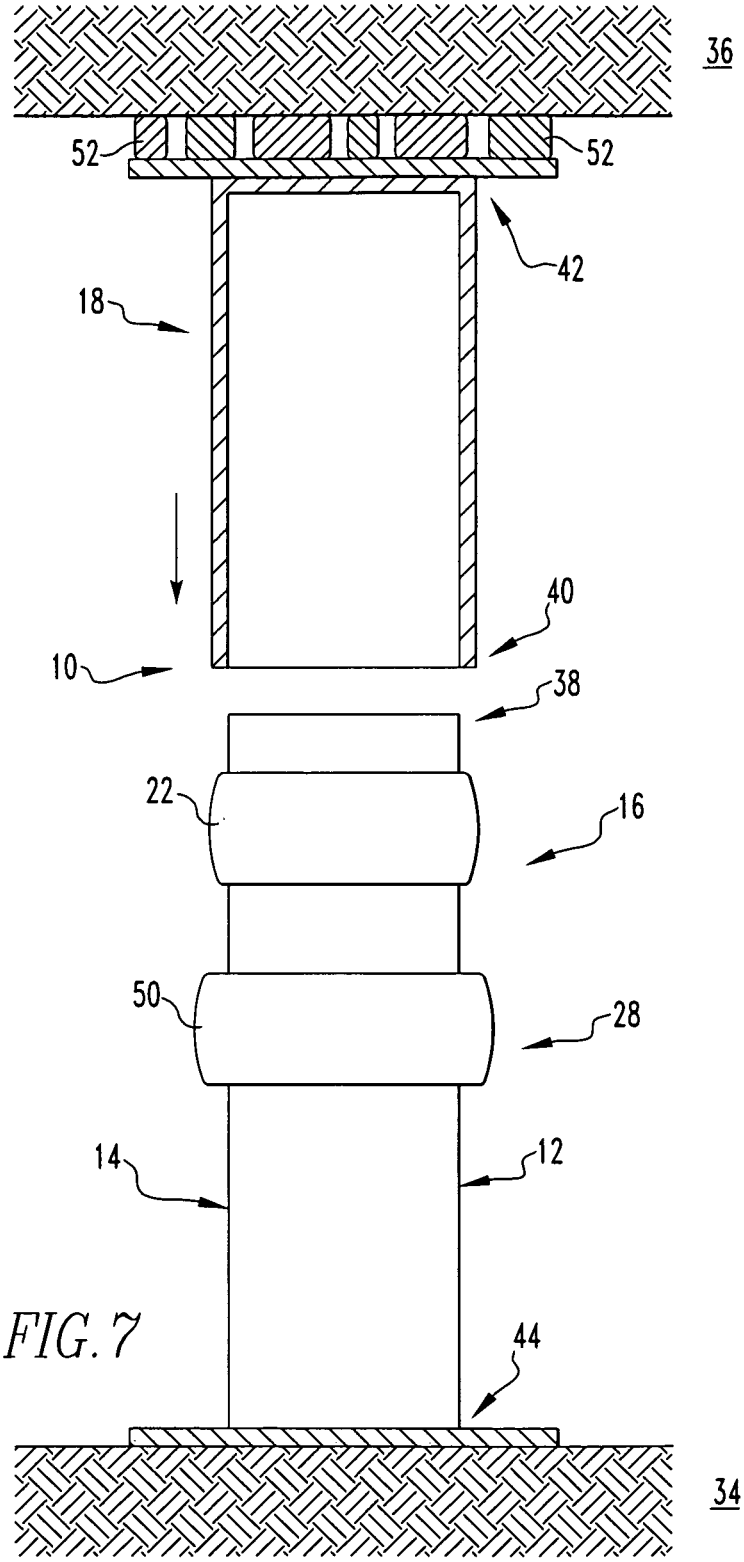
FIG. 7 shows a yieldable mine prop with a welded ring.

Referring now to the drawings wherein like reference numerals refer to similar or identical parts throughout the several views, and more specifically to FIGS. 6 and 7 thereof, there is shown a yield support prop 10 for a mine. The prop 10 comprises a first metal tube extending from the mine floor 34 having a first portion 14 having a first outside diameter and a second portion 16 having a second outside diameter. The prop 10 comprises a second metal tube that is disposed about the first portion 14 and extends toward the mine roof 36. When the second tube 18 receives a load from the mine roof 36, the second portion 16 deforms the second tube 18 and expands the second tube 18 creating resistance against the load from the mine roof 36.

The second portion 16 may include at least one metal bead 20 welded to the first portion 14 or a metal ring 22 welded to the first portion 14. The height of the second portion 16 may extend from the first portion 14 at least 0.15 inches more than the inside diameter of the second tube 18. The yield strength of the first tube 12 may be greater than the yield strength of the second tube 18. The first tube 12 may have a top end 38 and the second portion 16 is disposed about 3 inches to 9 inches from the top end 38 of the first tube 12.

Figure 9:
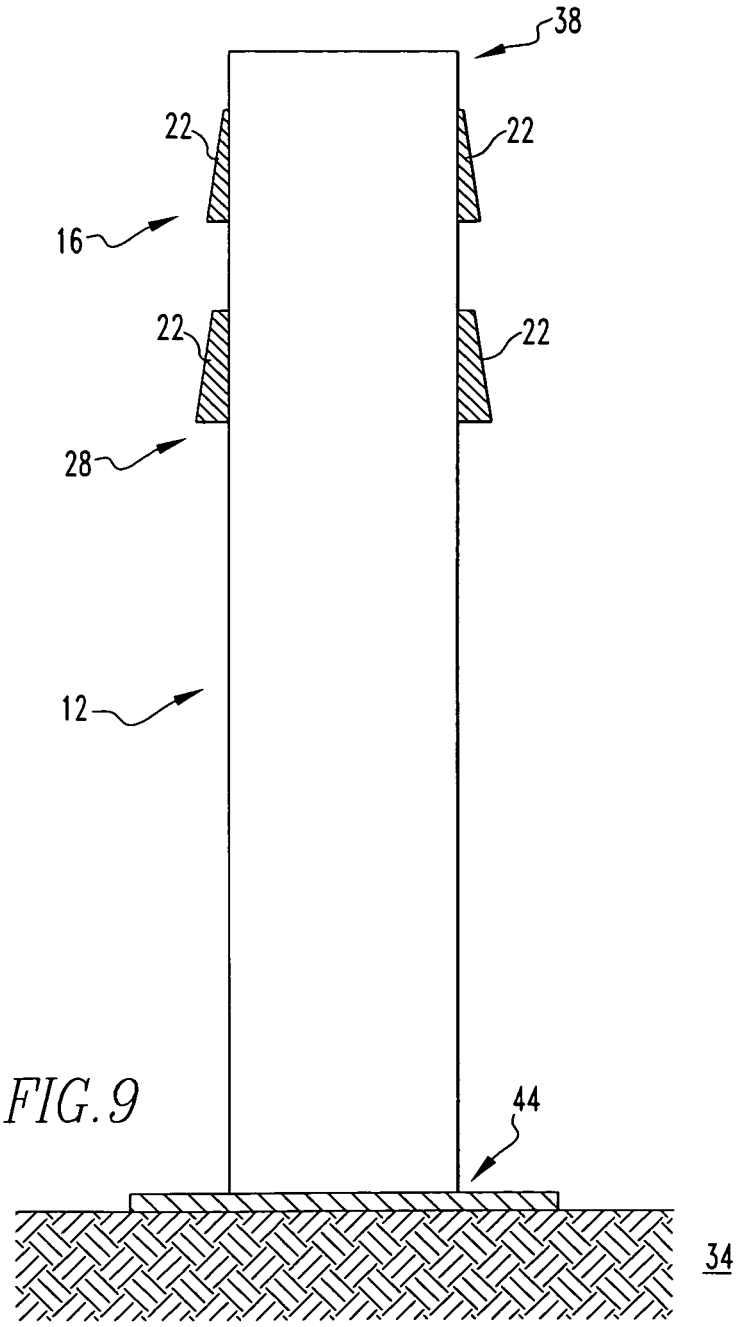
FIG. 9 shows a first tube with two weld rings having a wedge shape.

The second tube 18 may have a bottom end 40 which fits over the top end 38 of the first tube 12 and which is flared outward to facilitate placement of the second tube 18 on to the first tube 12. The length of the first tube 12 may be H minus X, where H is the mine height, and X is between 3 inches and 20 inches. The prop 10 may include at least one keeper tab 24 welded to the first tube 12 and the second tube 18 to keep the first and second tubes 12, 18 together. The prop 10 may include a metal head plate 46 attached to the top end 42 of the second tube 18 and a metal foot plate 48 attached to the bottom end 44 of the first tube 12. The prop 10 may include a handle 26 attached to the first tube 12. The ring 22 of the second portion 16 may have a shape of a wedge, as shown in FIG. 9.

The first tube 12 may have a third portion 28 having a third outside diameter disposed below the second portion 16 and having a height from the first portion 14 greater than the height of the second diameter from the first portion 14 which creates a progressive increase in support resistance through multiple stages of working the metal of the second tube 18. The third portion 28 may include at least a bead 20 having a height greater than the height of the bead 20 of the second portion 16. The third portion 28 may include a second ring 50 having a height greater than the height of the ring 22 of the second portion 16.

Figure 3:
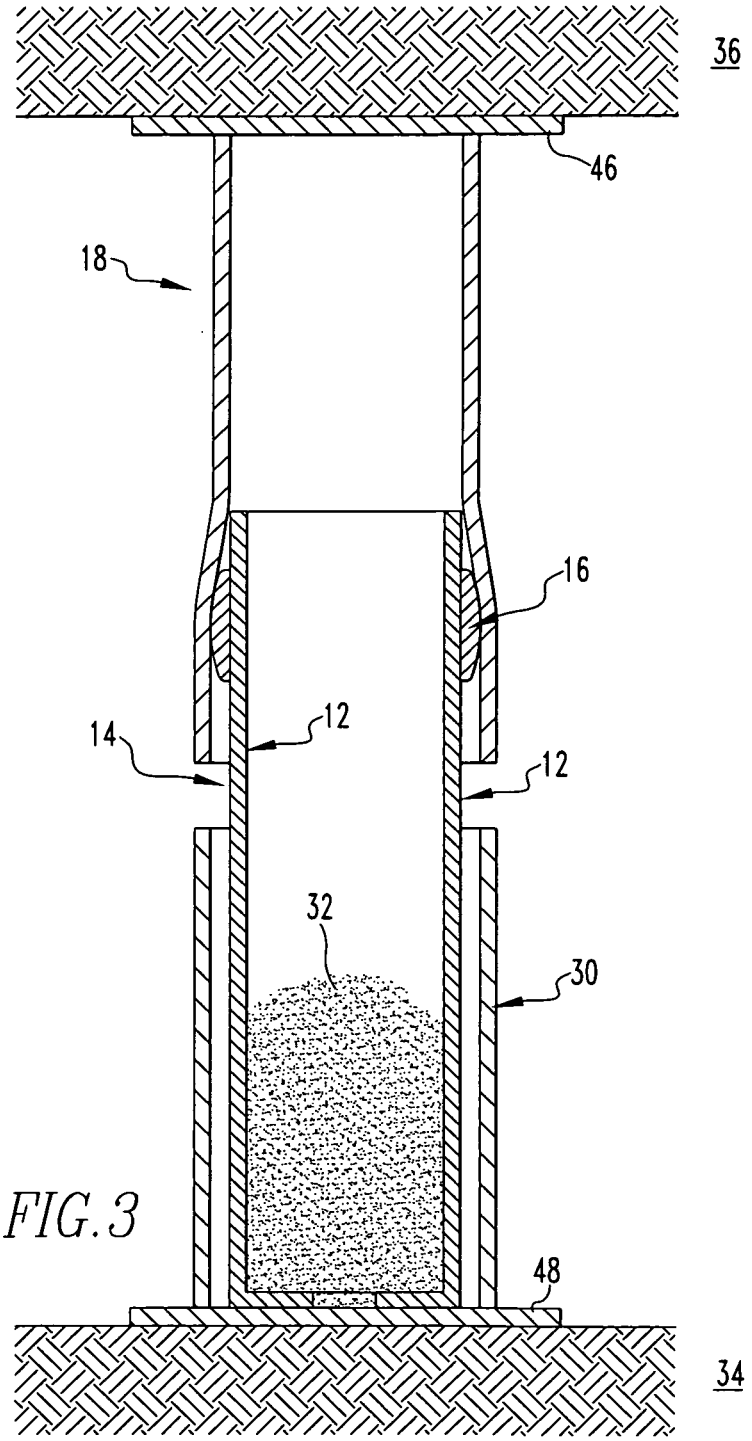
FIG. 3 shows the prop that has an adjustable height.
Figure 4:
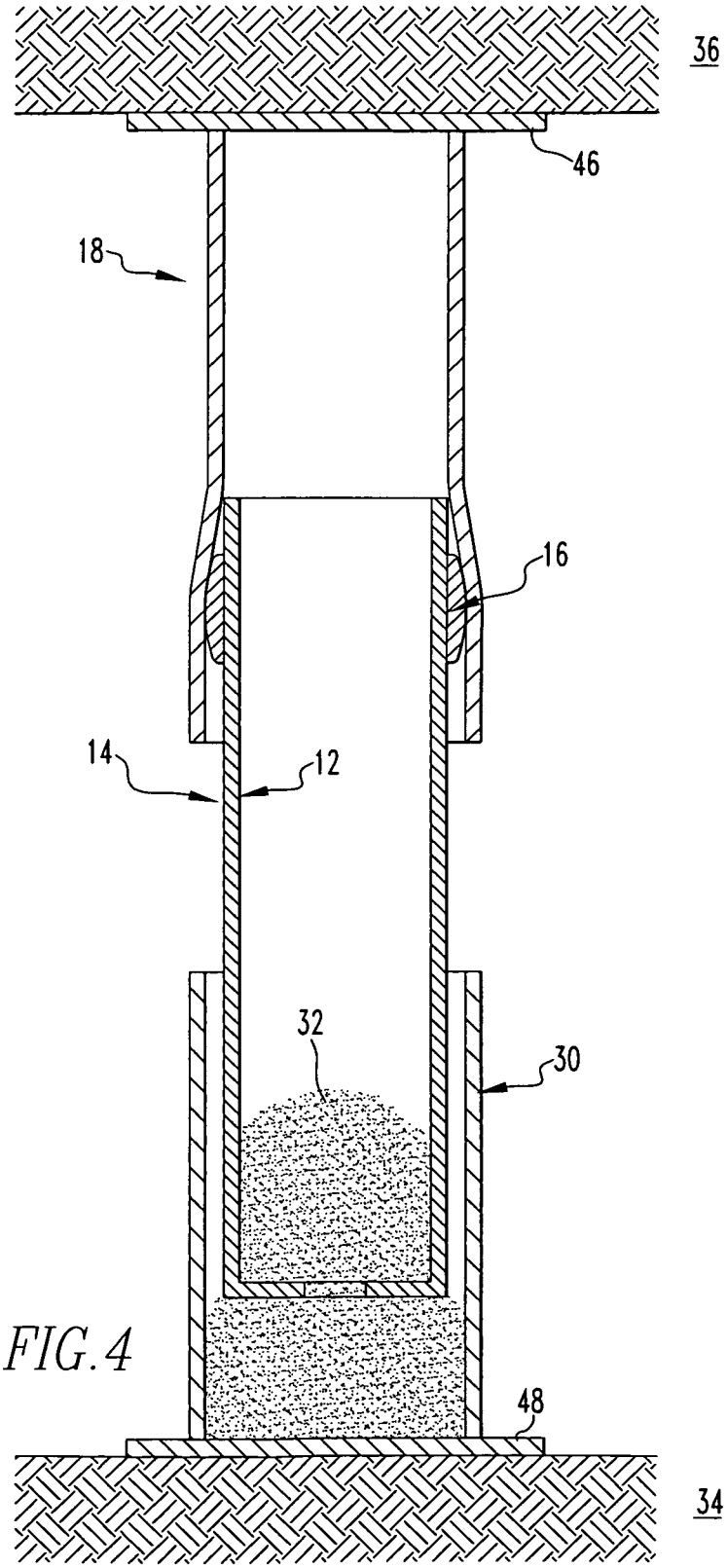
FIG. 4 shows the prop after its height has been extended.
Figure 5:
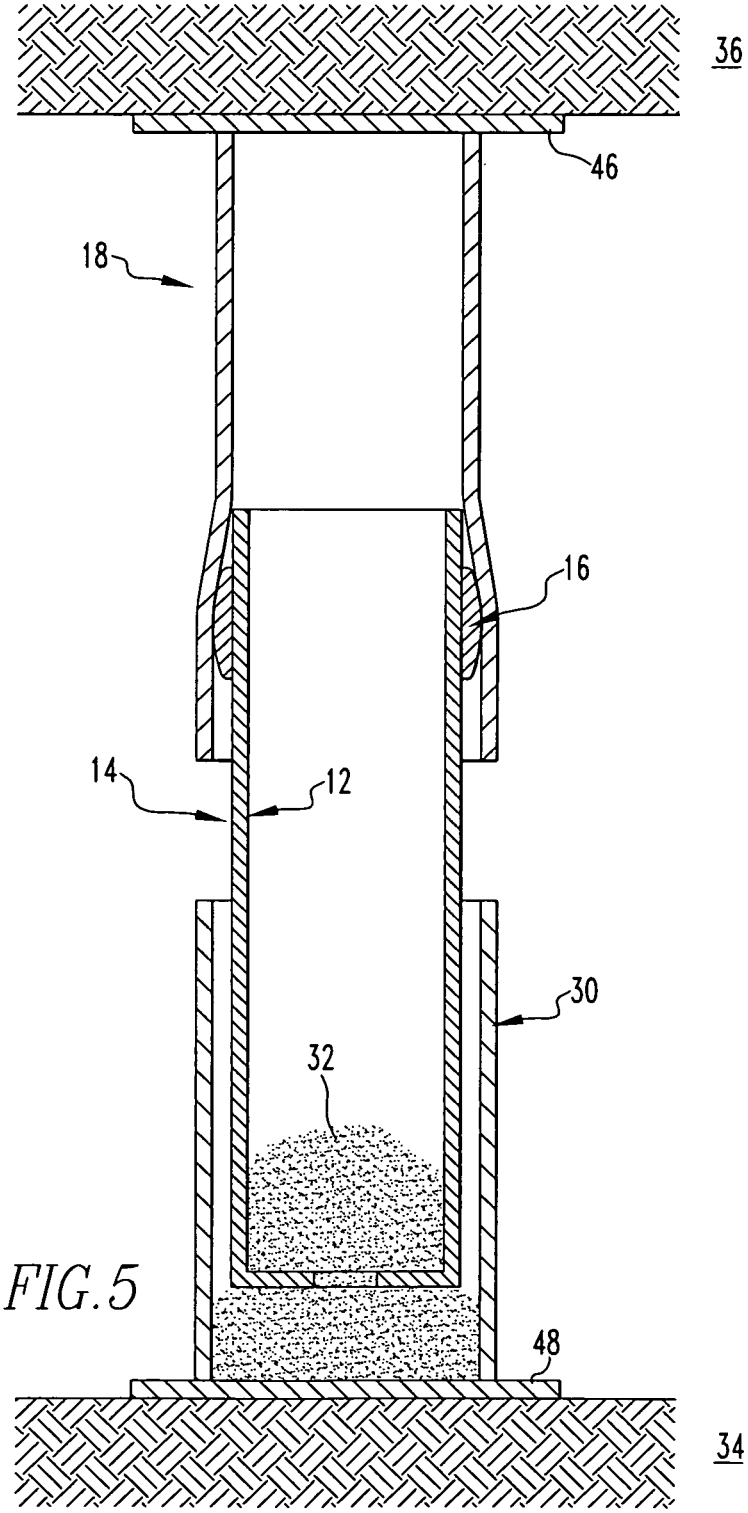
FIG. 5 shows the prop after its height has been extended and been deformed under load.

The prop 10 may include a container 30 in which the first tube 12 is disposed which allows the first tube's 12 height from which it extends from the floor to be adjusted, as shown in FIGS. 3-5. The container 30 may include sand 32, the level of which is used to adjust the height of the first tube 12.

The present invention pertains to a method for supporting a mine roof 36. The method comprises the steps of placing a yieldable mine prop 10 in the mine so a first metal tube of the prop 10 extends from the mine floor 34 and a second metal tube of the prop 10 extends from the first tube 12 toward the mine roof 36. There is the step of receiving a load from the mine roof 36 by the second tube 18. There is the step of moving the second tube 18 under the load against resistance from a second portion 16 of the first tube 12 that extends from a first portion 14 of the first tube 12 that deforms the second tube 18. There may be the step of adjusting the length of the prop 10.

The present invention pertains to a method for building a yieldable mine prop 10. The method comprises the steps of fitting a bottom end 40 of a second metal tube over a top end 38 of a first metal tube. There is the step of moving the bottom end 40 of the second tube 18 against a second portion 16 of the first tube 12 which extends from a first portion 14 of the first tube 12.

There may be the step of welding the second portion 16 to the first portion 14. There may be the step of welding a keeper tab 24 to the first tube 12 and the second tube 18 to keep the first and second tabs 24 together. There may be the step of flaring the bottom end 40 of the second tube 18 outward to facilitate fitting the second tube 18 over the first tube 12.

In regard to the operation of the invention, two alternative design approaches are provided. Both involve a prop 10 composed of at least two steel tubes the first of which has an outside diameter which is less than the inside diameter of the second tube 18. This would allow a telescoping type of fit such that there is no interference between the first and second tubes 12, 18. Tubes of this diameter relationship would not create a support unless a second portion or an "interference mechanism" was created to cause a resistance between the free passing of the first tube 12 through the second tube 18.

Two designs are described to create the "interference mechanism".

The first design is to create one or more weld beads 20 on the first tube 12 such that the effective outside diameter of the weld beads 20 create an interference with the inside diameter of the second tube 18. This interference would cause a resistance to tendency for the first tube 12 to pass freely through the second and would cause a friction and scraping action of the weld bead 20 against the second tube 18 and may depending on the mechanical properties of the second tube 18 cause the second tube 18 to expand concentrically to accommodate the effective diameter of the inner tube and weld bead(s) 20. These two tubes placed in contact with two opposing rock surfaces (such as the floor and roof of a mine) would create a resistance to closure of the rock surfaces.

The second design would incorporate using machined or cast, tapered or spherical ring made of steel or ductile iron. The ring would be welded to the first tube 12 and the combined diameter of the first tube 12 and ring would create interference between the effective outside diameter and the inside diameter of the second tube 18. Again as in the first design the interference created will create a friction and scraping action and the possible concentric expansion of the second tube 18. This again as in the first design, when placed between two rock surfaces would create a resistance to closure.

It is envisioned that the two tubes with interference mechanism would be assembled to create the effective closure resistance upon manufacture. The first tube 12 with interference mechanism would be assembled into the second tube 18 during manufacture, thus providing immediate resistance to closure when installed in the mine opening. It could be manufactured to fit exactly to the mine opening or blocked in place with timber or steel chocks 52, as shown in FIG. 7, on installation if the mine opening dimensions did not exactly match the manufactured length of the combined tubes.

Figure 1:
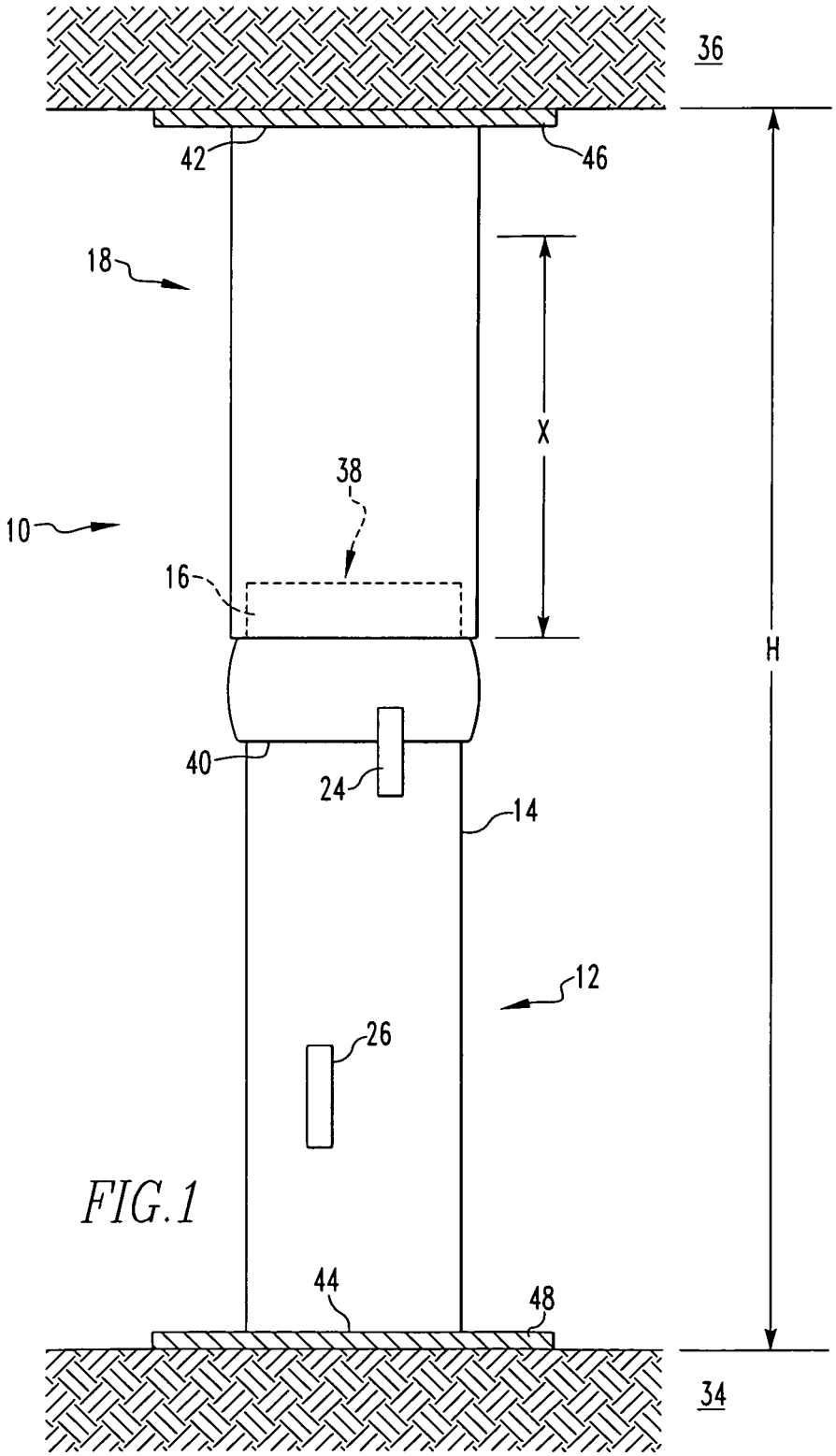
FIG. 1 shows a yieldable mine prop of the present invention.

FIG. 1 shows a yieldable mine prop 10 of the present invention.

Figure 2:
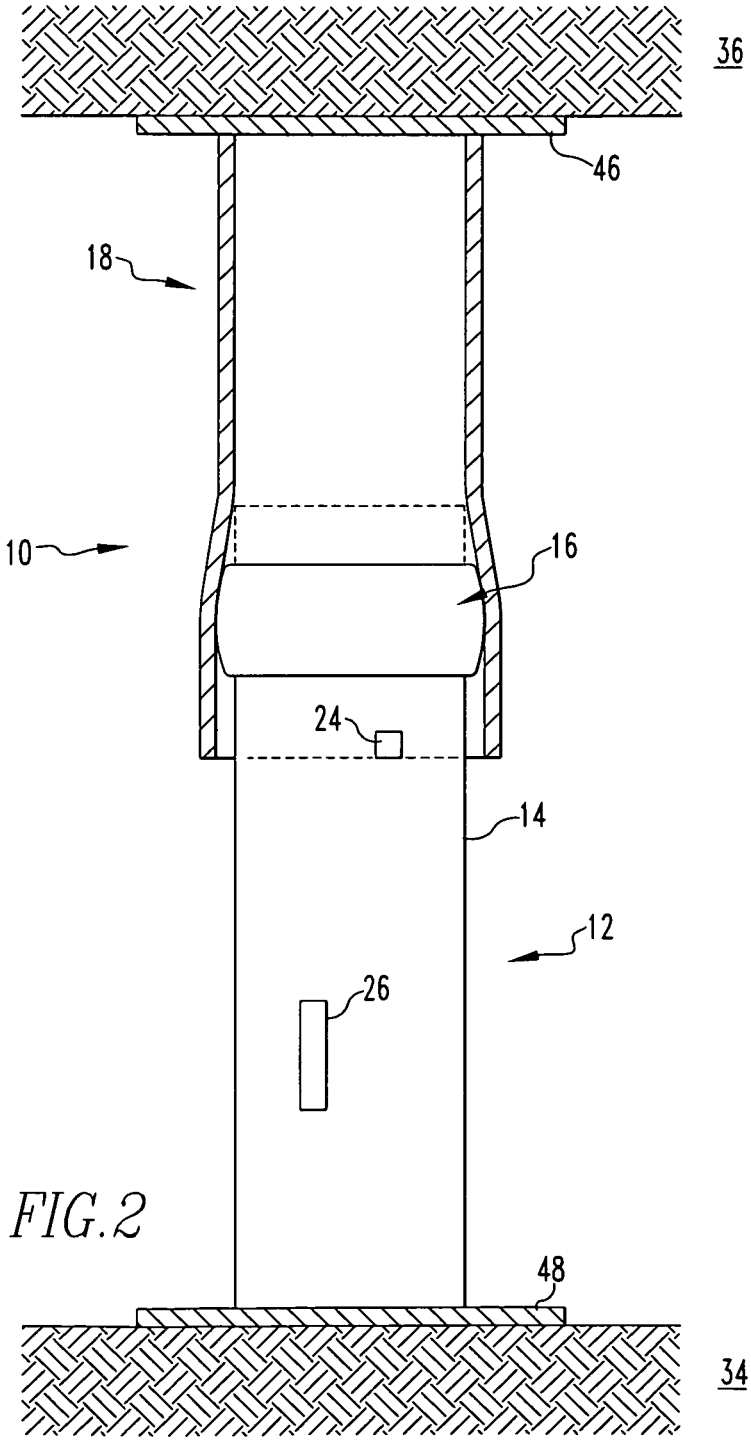
FIG. 2 shows a yieldable mine prop of the present invention that has deformed under load.

FIG. 2 shows a yieldable mine prop 10 of the present invention that has deformed under load.

FIG. 2 provides an example of how the support will deform while resisting the closure of the mine opening.

Alternatively, the two tubes could be incorporated into an adjustable installation mechanism that would allow the tubes to adapt to varying mine opening dimensions. One such configuration would be to incorporate these two tubes into the device currently sold by Strata Products LLC called the SandProp™. The SandProp™ uses an adjustment mechanism that allows the elongate support to accommodate varying mine opening dimensions. The SandProp™ is typically a non yielding support which when it reaches its peak strength will tend to buckle under the closure tendency of two rock surfaces and decrease its support capacity.

To incorporate the yielding feature of the designs disclosed one would use the upper (smaller diameter) tube of the SandProp™ as the first smaller diameter tube to which would be attached either the weld bead 20 or machined or cast welded ring 22. The second tube 18 would be forced onto the first tube 12 during manufacture. The end product is a support that has the rock closure resistance established in manufacture and the adjustable feature to accommodate varying mine opening dimensions. The upper or first tube 12 then has an opening in its base for material, such as sand, which fills the first tube, to escape and fill the lower tube of the SandProp™, here, a third tube. The first tube is lifted to a desired height, with sand pouring out the opening and filling the lower part of the third tube. The sand that is now in the third tube serves as a base for the elevated first tube. In such embodiment, the third tube should be even stronger than the first tube.

FIG. 3 shows the prop 10 that has an adjustable height.

FIG. 4 shows the prop 10 after its height has been extended.

FIG. 5 shows the prop 10 after its height has been extended and been deformed under load.

FIG. 6 shows a yieldable mine prop 10 with weld beads 20.

FIG. 7 shows a yieldable mine prop 10 with a welded ring 22.

Structural steel tubing is the preferred material for construction of the prop 10. Either using the weld bead 20 or ring 22 approach, two diameters and strengths of tube would be used.

The first tube 12, for example, would be hollow and have an outside diameter of about 2.875" and an inside diameter of 2.375". The yield strength of the steel used in the manufacture of this would be about 60,000 psi to 100,000 psi and preferably about 80,000 psi to provide a high resistance to bending during loading.

The second tube 18 would have an outside diameter of 3.500" and an inside diameter of 3.000". The yield strength of the steel used in the manufacture of this hollow tube would be about 35,000 psi to 75,000 psi and preferably about 55,000 psi to allow it to stretch circumferentially in response to the loading through the interference mechanism. The yield strength of the second tube should be less than the yield strength of the first tube. It can be seen that with the relationship of the diameters no inherent interference between the first tube 12 and second tube 18 exists.

The thickness of each tube is about 0.5 inches thick but could be between 0.3 and 0.7 inches thick, and the thickness of the tubes does not have to be about the same, depending on the strength and relationship desired between the tubes.

Length of the respective tubes that would be used are dependent on the height of the mine opening where the support is to be installed and the amount of closure to be designed into the support. That issue will be addressed below.

Weld Bead 20 Design

One preferred configuration of the weld bead 20 design is shown in FIG. 6. At a length of between three inches and nine inches and preferably about six inches from one end of the first tube 12 a bead 20 of weld is placed around the entire circumference of the tube. Commonly, a MIG welding process would be used to create this weld bead 20. The thickness of the bead 20 in this case would be 0.600" thus providing an outside diameter of the tube with weld bead 20 of 3.475". This clearly establishes a dimensional interference between the first and second tubes 12, 18.

For assembly of the device, one end of the second tube 18 would be flared outward using a hardened mandrel to a diameter of 3.500" to accept the first tube 12 with the weld bead 20 in place. Once assembled diametrically opposed "keeper tabs" would be welded in place on the second tube 18 to keep the two tubes together as a single unit. Handles 26 would also be added to the combined unit for portability. A steel head plate 46 and foot plate 48 would be welded to either end of the assembled device. The head plate 46 and foot plate 48 would be of A36 steel and have a thickness of 0.250" and a minimum square dimension of 4.00". The head plates 46 and footplates 48 spread bearing load out against the mine roof 36 and floor once the unit is in place and functioning.

For a specific application and using the simplest form of the support as shown on FIG. 1, the relative lengths of the tube would be determined as follows: The mining height is H and it is desired to provide support that can accept up to 12" of closure. The maximum length of the first tube 12 then will be H−12". Since the support is preassembled which takes 6" of the length of the second tube 18, a length of 18" is needed to be used to provide 12" of closure. In practical application the length of the first tube 12 would be made less than the maximum by say 4"-6" to make it easy to maneuver into position then wood blocking and wedges would used to secure the support in place. FIG. 2 shows the support of FIG. 1 after experiencing closure.

As an alternative to a single weld bead 20, a plurality of weld beads 20 could be placed on the first tube 12 as shown in FIG. 6. The plurality of weld beads 20 would be spaced apart at a distance of about an inch and the beads 20 would be of different thickness to create a progressive increase in support resistance through multiple stages on working the metal of the second tube 18. The plurality of weld beads 20 could be distributed over a longer length of the first tube 12 such as starting 8" from one end rather than 6". Flaring and adequate depth and shape of the flare of the second tube 18 must accommodate the additional weld bead length for assembly. Installation and use of the support with a plurality of weld beads 20 would be the same as above.

Machined Ring 22 Design

The second preferred configuration is to replace the weld beads 20 with machined rings. Testing has shown that this is a more dependable configuration in that the surface finish of the machined rings more controlled and load capacities more consistent. The rings could have a variety of forms that could be effective in creating the interference mechanism and thus support resistance. One simple form could hemispherical in cross-section taking much the same shape as the weld bead form as shown in FIG. 7. A plurality of these rings could also be used much like the plurality of weld beads 20. The rings would have progressively larger radial dimensions which would cause deformation of the second tube 18 in several stages. These rings would be welded onto the first tube 12 to secure them in place.

Figure 8A:
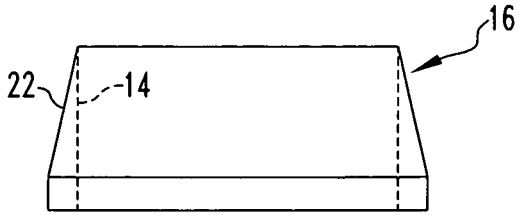
FIGS. 8*a*-8*c* show side, overhead and cross-sectional views of the second portion of the first tube.
Figure 8B:
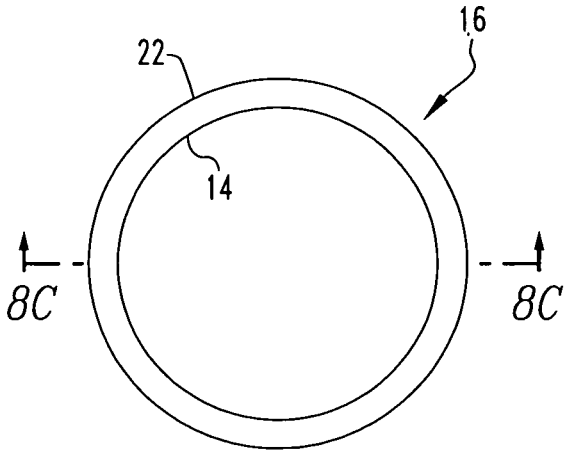
Figure 8C:
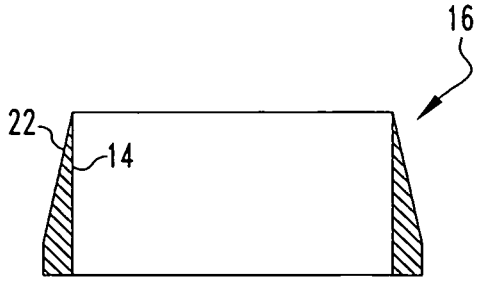

A machined ring in the form of a wedge has proven to provide the most consistent performance. To manufacture the wedge ring A 513 Type DOM tubing is used. Nominal dimensions of the tube is 3.5" OD and with 0.375" wall. FIGS. 8*a*-8*c* show the side, overhead and cross-section of the finished piece. Once machined the wedge ring is heat treated and tempered to achieve a finished hardness of 30-35 on the Rockwell C scale. The heat treating process is needed to prevent galling of the wedge ring and to provide added strength to be sure the geometry of the ring 22 does not change over the deformation distance of the support. The ring 22 is then welded into the desired position on the first tube 12. Typically, the base of the wedge ring 22 would be located 6" from one end of the first tube 12.

FIGS. 8*a*-8*c* show side, overhead and cross-sectional views of the second portion 16 of the first tube 12.

Like in the other designs a plurality of the wedge rings could be used with each ring 22 have a slightly larger dimensions as shown in FIG. 9. It is also practical for manufacturing purposes to produce a wedge ring 22 with multiple progressively larger wedge forms it has been realized the machining and assembly process is enhanced with single ring with multiple wedged surfaces. Such a ring is shown in FIGS. 10*a*-10*c*, which show side, overhead and cross-sectional views.

Figure 10A:
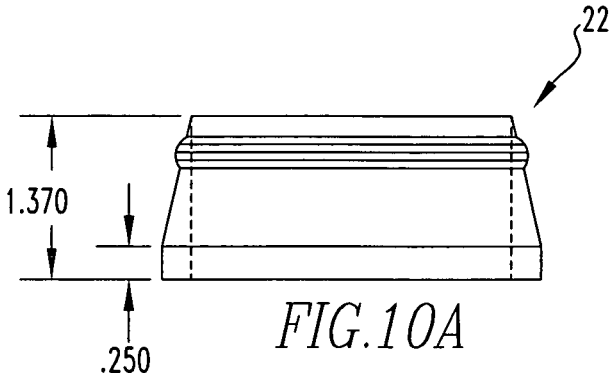
FIGS. 10*a, b* and *c* show side, overhead and cross-sectional views of a ring.
Figure 10B:
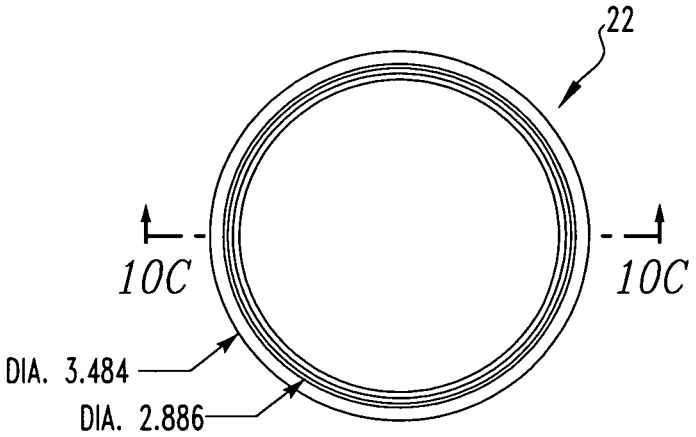
Figure 10C:
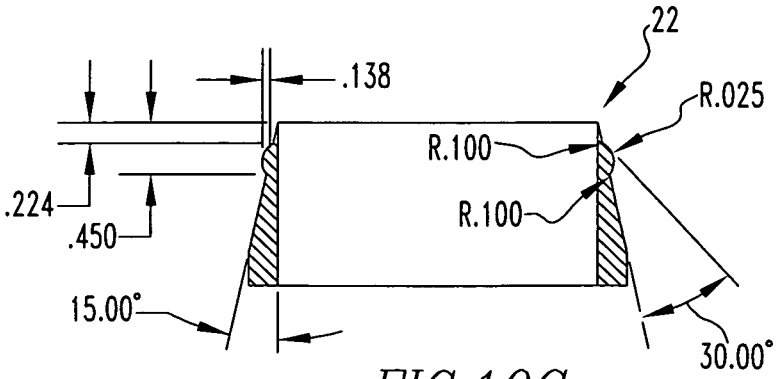

FIGS. 10*a, b* and *c* show side, overhead and cross-sectional views of a ring 22.

Figure 11:
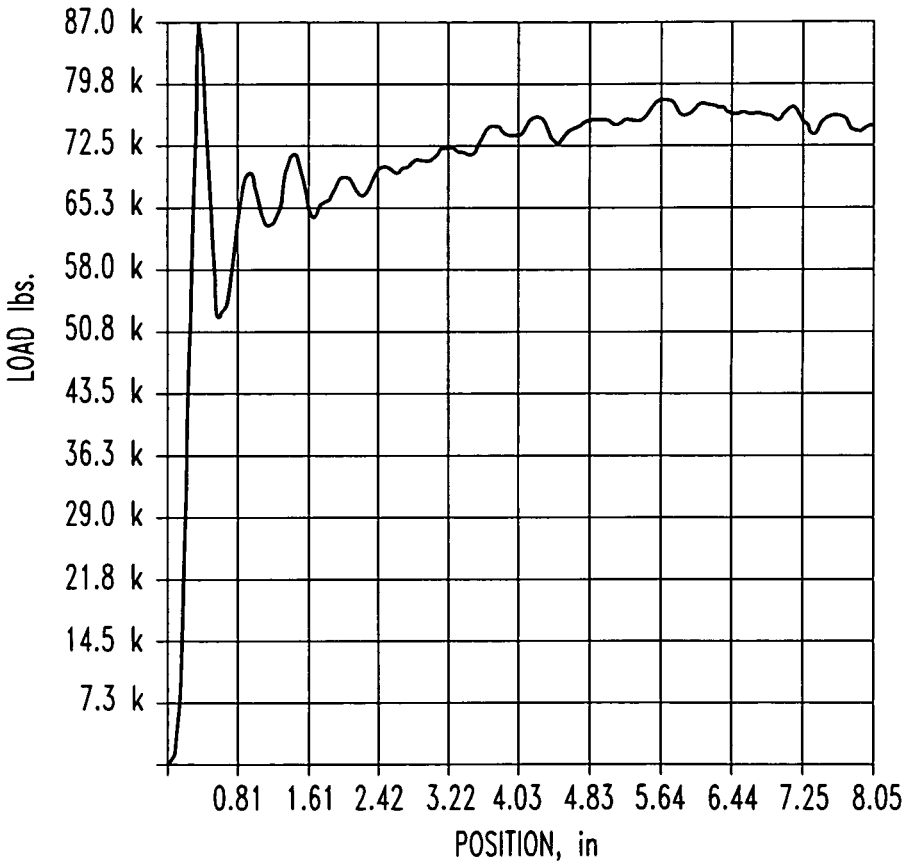
FIG. 11 provides an example of the load carrying capacity of the multiple wedge design as shown in FIG. 10.

FIG. 11 provides an example of the load carrying capacity of the multiple wedge design, as shown in FIG. 10.

In another embodiment, the second portion 16 is disposed on the inside of the first tube 12 and the second tube 18 fits inside the first tube 12. In yet additional alternative embodiments, the second tube 18 may have the second portion 16 on its outside, and the second tube 18 fits into the first tube 12; or the second portion 16 is disposed on the inside of the second tube 18 and the second tube 18 fits over the first tube 12. In both instances, the first tube 12 has a yield strength less than the yield strength of the second tube 18. Essentially all of the other features described would be applicable.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A yield support prop for a mine comprising:

a first metal tube extending from the mine floor having a first portion having a smooth first outside diameter and a second portion having a second outside diameter, the second portion includes at least one metal bead welded to the first portion or a metal ring welded to the first portion, the height of the second portion extends from the first portion at least 0.15 inches more than the inside diameter of the second tube, the yield strength of the first tube is greater than the yield strength of the second tube; and a second metal tube having a smooth inner diameter that is disposed about the first portion and extends toward the mine roof, when the second tube receives a load from the mine roof, the second tube slides down over the first tube and the second portion deforms the second tube and expands the second tube creating resistance against the load from the mine roof.

2. The prop of claim 1 wherein the first tube has a top end and the second portion is disposed about 3 inches to 9 inches from the top end of the first tube.

3. The prop of claim 2 wherein the second tube has a bottom end which fits over the top end of the first tube and which is flared outward to facilitate placement of the second tube on to the first tube.

4. The prop of claim 3 wherein the length of the first tube is H minus X, where H is the mine height, and X is between 3 inches and 20 inches.

5. The prop of claim 4 including at least one keeper tab welded to the first tube and the second tube to keep the first and second tubes together.

6. The prop of claim 5 including a metal head plate attached to the top end of the second tube and a metal foot plate attached to the bottom end of the first tube.

7. The prop of claim 6 including a handle attached to the first tube.

8. The prop of claim 7 wherein the ring of the second portion has a shape of a wedge.

9. The prop of claim 7 wherein the first tube has a third portion having a third outside diameter disposed below the second portion which creates a progressive increase in support resistance through multiple stages of working the second tubes metal.

10. The prop of claim 9 wherein the third portion includes at least a bead having a height greater than the height of the bead of the second portion.

11. The prop of claim 9 wherein the third portion includes a second ring having a height greater than the height of the ring of the second portion.

12. The prop of claim 7 including a container in which the first tube is disposed which allows the first tube's height from which it extends from the floor to be adjusted.

13. The prop of claim 12 wherein the container includes sand, the level of which is used to adjust the height of the first tube.

14. A method for supporting a mine roof comprising the steps of:

placing a yieldable mine prop in the mine so a first metal tube of the prop extends from the mine floor and a second metal tube of the prop extends from the first tube toward the mine roof;

receiving a load from the mine roof by the second tube; and sliding the second tube under the load against resistance from a second portion of the first tube that extends from a first portion of the first tube having a smooth outer diameter that deforms the second tube, the second portion includes at least one metal bead welded to the first portion or a metal ring welded to the first portion, the height of the second portion extends from the first portion at least 0.15 inches more than the inside diameter of the second tube, the yield strength of the first tube is greater than the yield strength of the second tube, the second metal tube having a smooth inner diameter that is disposed about the first portion.

15. The method of claim 14 including the step of adjusting the length of the prop.

16. A method for building a yieldable mine prop comprising the steps of:

welding a second portion to a first portion having a smooth first outside diameter, the second portion includes at least one metal bead welded to the first portion or a metal ring welded to the first portion, the height of the second portion extends from the first portion at least 0.15 inches more than the inside diameter of the second tube;

fitting a bottom end of a second metal tube having a smooth inner diameter over a top end of a first metal tube; and moving the bottom end of the second tube against the second portion of the first tube which extends from a first portion of the first tube, the yield strength of the first tube is greater than the yield strength of the second tube.

17. The method of claim 16 including the step of welding a keeper tab to the first tube and the second tube to keep the first and second tabs together.

18. The method of claim 17 including the step of flaring the bottom end of the second tube outward to facilitate fitting the second tube over the first tube.

* * * * *